US010458091B2

(12) United States Patent
Jung

(10) Patent No.: US 10,458,091 B2
(45) Date of Patent: Oct. 29, 2019

(54) PILE DRIVING MACHINE

(71) Applicant: IHC HOLLAND IE B.V., Sliedrecht (NL)

(72) Inventor: Boudewijn Casper Jung, Bergen op Zoom (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 245 days.

(21) Appl. No.: 14/898,709

(22) PCT Filed: Jun. 18, 2014

(86) PCT No.: PCT/NL2014/050401
§ 371 (c)(1),
(2) Date: Dec. 15, 2015

(87) PCT Pub. No.: WO2014/204308
PCT Pub. Date: Dec. 24, 2014

(65) Prior Publication Data

US 2016/0122968 A1 May 5, 2016

(30) Foreign Application Priority Data

Jun. 18, 2013 (NL) ..... 2011003

(51) Int. Cl.
*E02D 7/06* (2006.01)
*E02D 13/06* (2006.01)
(Continued)

(52) U.S. Cl.
CPC ..... *E02D 13/06* (2013.01); *E02B 17/0004* (2013.01); *E02D 7/02* (2013.01);
(Continued)

(58) Field of Classification Search
CPC .... E02D 7/00; E02D 7/02; E02D 7/06; E02D 7/08; E02D 7/10; E02D 13/06
See application file for complete search history.

(56) References Cited

U.S. PATENT DOCUMENTS 3,800,548 A * 4/1974 Wisotsky ..... E02D 7/28 173/1
3,817,091 A * 6/1974 Frederick ..... E02D 13/06 173/210
(Continued)

FOREIGN PATENT DOCUMENTS

CN 1547636 A 11/2004
CN 102296607 A 12/2011
(Continued)

OTHER PUBLICATIONS

International Search Report, dated Dec. 24, 2014, for corresponding International Patent Application No. PCT/NL2014/050401, filed Jun. 18, 2014.
(Continued)

*Primary Examiner* — Frederick L Lagman
(74) *Attorney, Agent, or Firm* — Steven M. Koehler; Westman, Champlin & Koehler, P.A.

(57) ABSTRACT

A pile measuring system suitable for determining parameter (s) of a pile during an installation of the pile is disclosed. The pile measuring system comprises at least one positioning sensor and a parameter calculator. Each of the at least one positioning sensor is attached or attachable to a location on a sleeve and configured to measure position coordinates of the respective location on the sleeve. The parameter calculator is suitable for determining the parameter(s) of the pile from the position coordinates measured by the at least one positioning sensor.

21 Claims, 7 Drawing Sheets

(51) Int. Cl.

| | |
|---|---|
| ***E02D 7/02*** | (2006.01) |
| ***E02D 7/14*** | (2006.01) |
| ***E02B 17/00*** | (2006.01) |

(52) U.S. Cl.
CPC ..... *E02D 7/06* (2013.01); *E02D 7/14* (2013.01); *E02B 2017/0091* (2013.01)

(56) References Cited

U.S. PATENT DOCUMENTS

| | | | | |
|---|---|---|---|---|
| 4,619,218 | A * | 10/1986 | Kenny | B63B 21/28 114/295 |
| 4,799,557 | A | 1/1989 | Jacquetmet | |
| 5,894,781 | A * | 4/1999 | Kuvshinov | E02D 7/10 91/246 |
| 5,978,749 | A | 11/1999 | Likins, Jr. et al. | |
| 9,080,302 | B2 | 7/2015 | Jung | |
| 2002/0148298 | A1* | 10/2002 | McVay | E02D 13/06 73/760 |
| 2004/0099063 | A1* | 5/2004 | Frederick | E02D 13/06 73/818 |
| 2006/0021447 | A1* | 2/2006 | Hecht | E02D 5/22 73/803 |
| 2007/0039748 | A1* | 2/2007 | Kennett | E04H 17/263 173/117 |
| 2007/0074881 | A1* | 4/2007 | Bermingham | E02D 7/02 173/2 |
| 2008/0177450 | A1* | 7/2008 | Daniel | E02D 13/06 701/50 |
| 2010/0012336 | A1* | 1/2010 | Adamson | E02D 7/02 173/1 |
| 2012/0315097 | A1* | 12/2012 | Paulus | E02D 13/04 405/224 |
| 2014/0023442 | A1 | 1/2014 | Jung | |
| 2014/0314495 | A1* | 10/2014 | Arentsen | E02D 7/10 405/232 |
| 2016/0130777 | A1* | 5/2016 | Stam | E02D 7/06 405/228 |

FOREIGN PATENT DOCUMENTS

| | | | |
|---|---|---|---|
| CN | 2012134279 | A1 | 4/2012 |
| CN | 103031844 | A | 4/2013 |
| EP | 1270824 | A2 | 1/2003 |
| EP | 2468960 | A1 | 6/2012 |
| EP | 2532790 | A1 | 12/2012 |
| GB | 2316486 | A | 2/1998 |
| JP | S63236819 | A | 10/1988 |
| JP | H07197461 | A | 8/1995 |
| JP | 3676277 | B2 | 7/2005 |
| JP | 2011214307 | A | 10/2011 |
| JP | 2012127923 | A | 7/2012 |
| JP | 200140653 | A | 2/2013 |
| RU | 2301301 | C2 | 6/2007 |
| WO | 2012010119 | A2 | 1/2012 |
| WO | 2012134279 | A1 | 10/2012 |

OTHER PUBLICATIONS

Written Opinion, dated Dec. 18, 2015, for corresponding International Patent Application No. PCT/NL2014/050401, filed Jun. 18, 2014.

Viljamaa et al.: "Utilisation of a 3D design data in controlling pile driving", Proceedings of CIB W78. 27th International Conference on Applications of IT in the AEC Industry, Cairo, Egypt, Nov. 16-19, 2010.

Chinese Office Action for Chinese patent application No. 20148034755.1, dated Aug. 11, 2016.

Cuiping, Lin, "Automated implementation and Application of Pile-Sinking Parameters of Circular Piles of High-Pile Wharf" China Water Transport, vol. 12, Issue 12, pp. 115 and 236-238, Dec. 31, 2012.

Second Chinese Office Action for Chinese patent application No. 201480034755.1, dated Apr. 1, 2017.

Communication from the European Patent Office for European patent application No. 14737037.3, dated Mar. 14, 2017.

Japanese Office Action, dated Feb. 26, 2018 for corresponding Japanese Patent Application No. 2016-521242, filed Jul. 21, 2016.

Japanese Office Action, dated Oct. 29, 2018 for corresponding Japanese Patent Application No. 2016-521242, filed Dec. 14, 2015.

* cited by examiner

PILE DRIVING MACHINE

CROSS-REFERENCE TO RELATED APPLICATION

The present application is a national stage filing of International patent application Serial No. PCT/NL2014/050401, filed Jun. 18, 2014, and published as WO 2014/204308 A1 in English.

FIELD OF INVENTION

The disclosure generally relates to the field of pile driving. In particular, though not necessarily, the disclosure relates to methods, systems, and a computer program product for determining or measuring parameters of a pile and/or driving a pile.

BACKGROUND

Pile driving is employed for installing piles (or generally referred to as foundation elements) into the ground. The piles generally provide structural support for structures such as wind turbines, and these structures are subsequently placed at the top of a pile installed in the ground. During the installation of a pile, surveyors manually calculate parameters of the pile to adjust the installation of the pile to ensure that the pile is sufficiently, e.g., perpendicular, such that the pile is properly installed into the ground. For instance, the surveyors may determine the inclination of a pile during installation to ensure that the pile is as vertical as possible. Various systems have been used for measuring parameters of a pile.

SUMMARY

The invention relates i.a. to a pile measuring system suitable for determining parameter(s) of a pile during installation of the pile is disclosed. Said pile is drivable into the ground by a pile driver. Said pile driver comprises a hammer and a sleeve, and said hammer and said sleeve are placed at the top of the pile when the pile is being installed into the ground.

Said pile measuring system comprises at least one positioning sensor, wherein preferably each of the at least one positioning sensor is attached or attachable to a location on the sleeve and configured to measure position coordinates of the respective location on the sleeve. Advantageously, measurements made by the pile measuring system, i.e., the at least one positioning sensor, is more accurate than known systems because the pile measuring system is installed preferably as close to the top of the pile as possible, i.e., the part of the pile which matters the most for properly and accurately placing a structure on top of the pile.

The pile measuring system may further comprise a parameter calculator for determining the parameter(s) of the pile from the position coordinates measured by the at least one positioning sensor. Advantageously, the parameters of the pile may be recorded and/or communicated to a control system configured to adjust the pile during installation. Furthermore, the combination of the at least one positioning sensor and the parameter calculator provides an efficient system for measuring the pile by reducing man-hours typically spent on measuring the pile, as well as reducing the delay caused by measurements being made manually or parameters being calculated manually during installation of the pile. Reducing the need to rely on human surveyors also enable more measurements to be made, which provides finer granularity in measuring the parameter(s) of the pile during installation.

According to one aspect, the parameter(s) determined by the parameter calculator comprises at least one of: position information, orientation information, inclination information, and depth information of the pile. The pile measuring system is advantageously capable of determining more parameters of the pile than known systems.

According to one aspect, the parameter calculator is configured to provide the parameter(s) to a pile driving control system, said pile driving control system configured to determine actuator parameter(s) from the parameter(s) for moving a gripper. Said gripper is configured to position the pile. Based on actuator parameter(s) and/or commands to the gripper, the gripper is configured to adjust the position of the pile during installation. Advantageously, the pile driving control system enables automatic (or at least semi-automatic) pile driving. The adjustment made by the gripper moves the pile such that desired parameter(s) of the pile can be met for proper installation of the pile. For instance, based on position information determined by the parameter calculator, the pile driving control system may determine an actuator parameter for commanding the gripper to move the pile towards a desired position with a particular amount of force. Orientation information (heading) and inclination information (perpendicularity) are also parameters determined by the parameter calculator that may be used to determine actuator parameter(s) for reaching the desired orientation or desired inclination of the pile.

According to one aspect, the parameter calculator is configured to provide the parameter(s) to a pile driving control system. Said pile driving control system is configured to determine hammer parameter(s) for controlling the energy of the hammer. Advantageously, the pile driving control system is configured to control the rate at which the pile is driven into the ground by controlling the energy of the blows the hammer applies to the pile based on the depth of the pile. The energy of a blow for hammering the pile further into the ground may be adjusted based on the rate at which the pile is driven deeper and deeper into the ground. The rate at which the pile is driven into the ground in relation to the number of blows applied to a pile (e.g., the number of blows for driving the pile into the ground for a particular distance or change in depth) is an important factor in ensuring the integrity of the pile.

According to one aspect, the at least one positioning sensor is attached or attachable to an upper surface of the sleeve. According to another aspect, each positioning sensor is configured to measure position coordinates at a location substantially close to the uppermost part of the pile (i.e., the part of the pile most far away from the ground during installation). Advantageously, the positioning sensor is able to more directly measure the parameters of the pile at the top (uppermost part) of the pile, which is the location that matters the most for installing a structure on top of the pile. In an embodiment, the distance between the upper rim of the pile and the positioning sensor is less than 5 meters, preferably less than 2 meters, preferably less than 1 meter.

According to one aspect, each positioning sensor is a global positioning system antenna configured to receive at least three different satellite signals. The position coordinates are determinable from the at least three different satellite signals. The position coordinates comprises longitude information and latitude information, and preferably elevation information. The position coordinates provides the basic measurement of the pile from which pile parameter(s)

can be calculated. Based on where the positioning sensors are placed on the sleeve (and in relation to the pile itself), the parameter calculator is configured to determine various parameters of the pile, e.g., using one or more geometry formulas.

According to one aspect, the at least one positioning sensor comprises two positioning sensors, and the parameter(s) determinable by the parameter calculator comprises at least one of: position information, orientation information, inclination information in a first direction, and depth information of the pile.

According to one aspect, the at least one positioning sensor comprises three or more positioning sensors, and the parameter(s) determinable by the parameter calculator comprises at least one of: position information, orientation information, inclination information in a first direction, inclination information in a second direction, and depth information of the pile.

According to one aspect, the pile measuring system further comprises a positioning beacon attachable or attached to the pile after the installation of the pile. Said positioning beacon is configured to measure position coordinates at the installed pile from satellite signals. Said system is further configured to provide, to the parameter calculator and during installation of a further pile, a difference between the position coordinates of the beacon on the installed pile measured from satellite signals and known position coordinates of the beacon at the installed pile. Advantageously, the positioning beacon increases the accuracy of the position coordinates measured by the at least one positioning sensors on a further pile, especially at locations where position parameters are not accurately known, such as offshore locations.

A method for determining parameters of a pile is also disclosed. Examples of a suitable parameter of pile such as position information, orientation information, inclination information, and depth information of the pile. The method is suitable for use during an installation of the pile, e.g., with the pile measuring system described above. Said pile is drivable into the ground by a pile driver. Said pile driver comprises a hammer and a sleeve, and said hammer and said sleeve are placed at the top of the pile.

The method comprises providing at least one positioning sensor attachable on a respective location on the sleeve. Further, the method comprises measuring, by the at least one positioning sensor, position coordinates of the respective location on the sleeve. The method further includes determining, by a parameter calculator, the parameter(s) of pile from the position coordinates measured by the at least one positioning sensors.

According to one aspect, the method further comprises providing, by the parameter calculator, the parameter(s) to a pile driving control system. Said pile driving control system may include a gripper parameter calculator configured to determine actuator parameter(s) for moving a gripper. Said gripper is configured to position the pile. In place of or additionally to the gripper parameter calculator, the pile driving control system may include a hammer parameter calculator configured to determine hammer parameter(s) for controlling the energy of the hammer.

According to one aspect, the method further comprises providing a positioning beacon attachable to the pile after the installation of the pile. Said positioning beacon is configured to measure position coordinates at the pile from satellite signals. Furthermore, the method comprises receiving, at the parameter calculator, a difference between the position coordinates at the pile measured from satellite signals and known position coordinates of the positioning beacon at the pile during an installation of another pile.

The disclosure also relates to a computer program product, implemented on computer-readable non-transitory storage medium, wherein the computer program product may comprise software code portions configured for, when run on a computer, executing the method steps according to any of the methods described in the present disclosure. The computer program product is preferably implemented at least in part in any of: the parameter calculator, the pile driving control system, the gripper parameter calculator, the hammer parameter calculator, a position calculator, a orientation calculator, an inclination calculator, a depth calculator, a report generator, etc.

The disclosure will further be illustrated with reference to the attached drawings, which schematically show embodiments according to the disclosure. Hereinafter, embodiments of the invention aiming to alleviate the problem(s) described above will be described in further detail.

BRIEF DESCRIPTION OF THE DRAWINGS

Aspects of the invention will be explained in greater detail by reference to exemplary embodiments shown in the drawings, in which.

DETAILED DESCRIPTION

Figure 1:
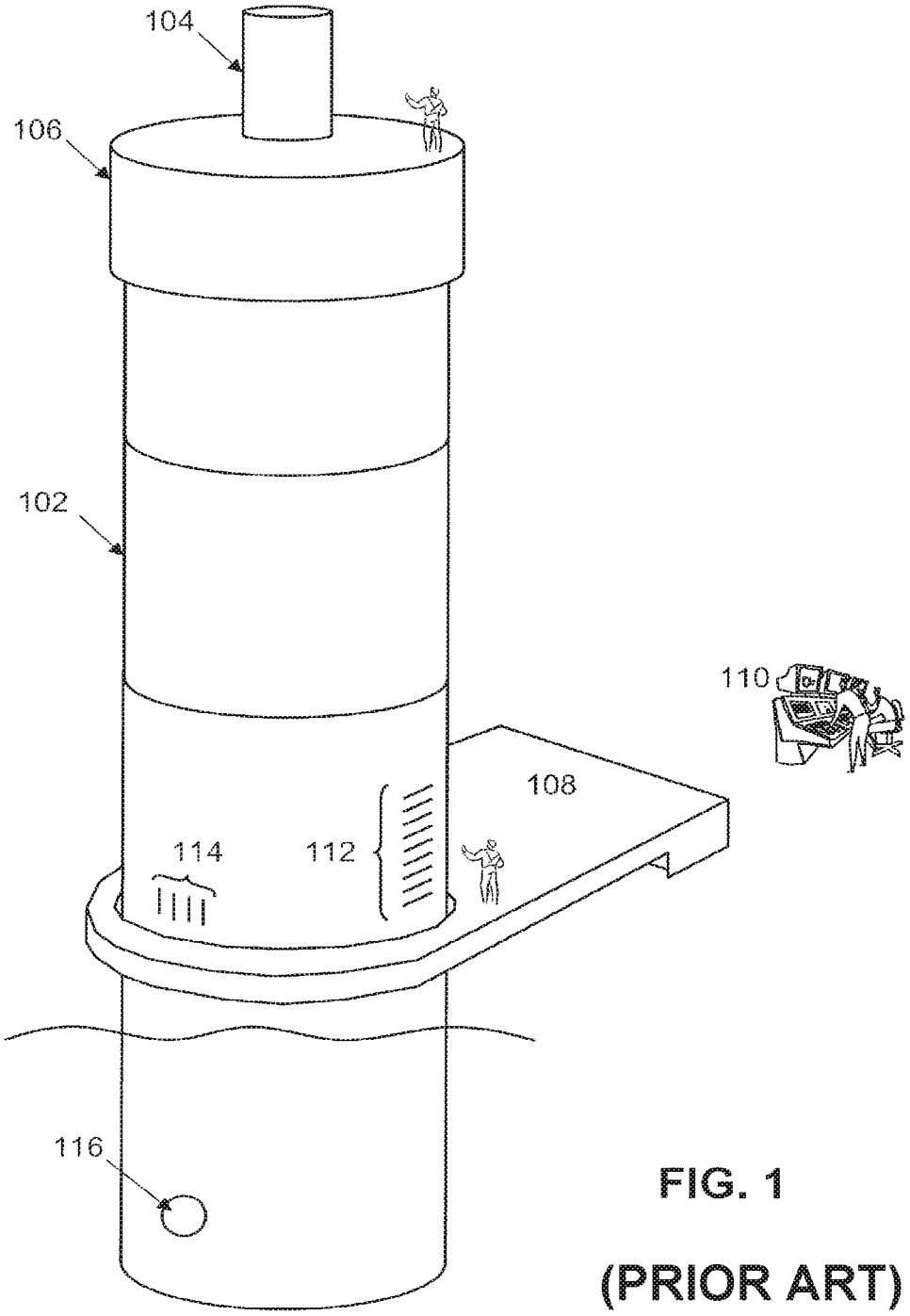
FIG. 1 (PRIOR ART)
FIG. 1 shows a conventional pile driving system.

FIG. 1 shows a conventional pile driving system. For illustration, the conventional pile driving system is suitable for driving a pile 102, e.g., a monopile, into the ground (for example, a seabed). A pile may range from 1 meter to 10 meters in diameter, and generally comprises a plurality of welded portions, wherein one portion is welded and stacked on top of another portion when the pile is in a vertical position. In the context of this disclosure, the top of the pile refers to the uppermost part of the pile.

Typically, a pile should to be placed within 0.5 degrees from the vertical at a position within 1 meter from the intended/desired position for the installation. In some cases, the pile is required to be placed at a particular heading or orientation for cable entry. The pile may be installed at sea for supporting a structure, e.g., a wind turbine, at the top of a pile. Thus, the accuracy of a pile installation depends primarily on whether the pile, especially the top part of the pile is installed within the tolerable margins. The parameters of the pile, such as position information and perpendicularity, may differ significantly from one welded portion to another welded portion. Furthermore, the accuracy of installing a structure on top of the pile depends primarily on the parameters of the transition piece, i.e., a piece at the top of the pile that connects the structure with the pile, which is often required to be placed at within 0.05 degrees from the vertical. Because the pile comprises a plurality of welded portions, measurements of the pile at a different part from the top part of the pile is not as accurate as measurements of the pile at the top of the pile.

In the context of this disclosure, positioning a pile relates to determining certain parameter(s) of the pile and adjusting the pile driving system to place the pile according to specified requirements based on the determined parameter(s). The parameters of a pile may include at least one of: position information, orientation information, inclination information, and depth information.

The pile driving system comprises a pile driver. The pile driver comprises a hammer 104 (only a part of the hammer is shown for illustrative purposes) and a sleeve 106. The pile driving system further comprises a gripper 108 for moving (e.g., guiding and/or adjusting) the pile. During installation of the pile, the parameters of the pile change from blow to blow. An operator 110 of the pile driving system, e.g., on a vessel, accordingly gathers, e.g., manually, those parameters at different times during the installation, e.g., from surveyors, and then determines how the pile driving system should be adjusted. The operator may use the gripper to adjust the positioning of the pile during an installation.

Mark(s) 112 may be made on the pile to indicate the depth information of the pile to a surveyor. In some cases, mark(s) 114 may be made on the pile to mark a reference point to indicate the orientation information of the pile to the surveyor, such that, e.g., the surveyor may determine whether, e.g., an opening 116 in the pile is pointing towards the specified direction for cable entry. Surveyors may work on the sleeve or use mirrors installed on the vessel to determine the inclination information. The position information of the pile may be calculated based on the position of the vessel and the relative position of the vessel with the pile. The present disclosure discloses methods and systems, which improve upon the conventional means described with FIG. 1.

Figure 2:
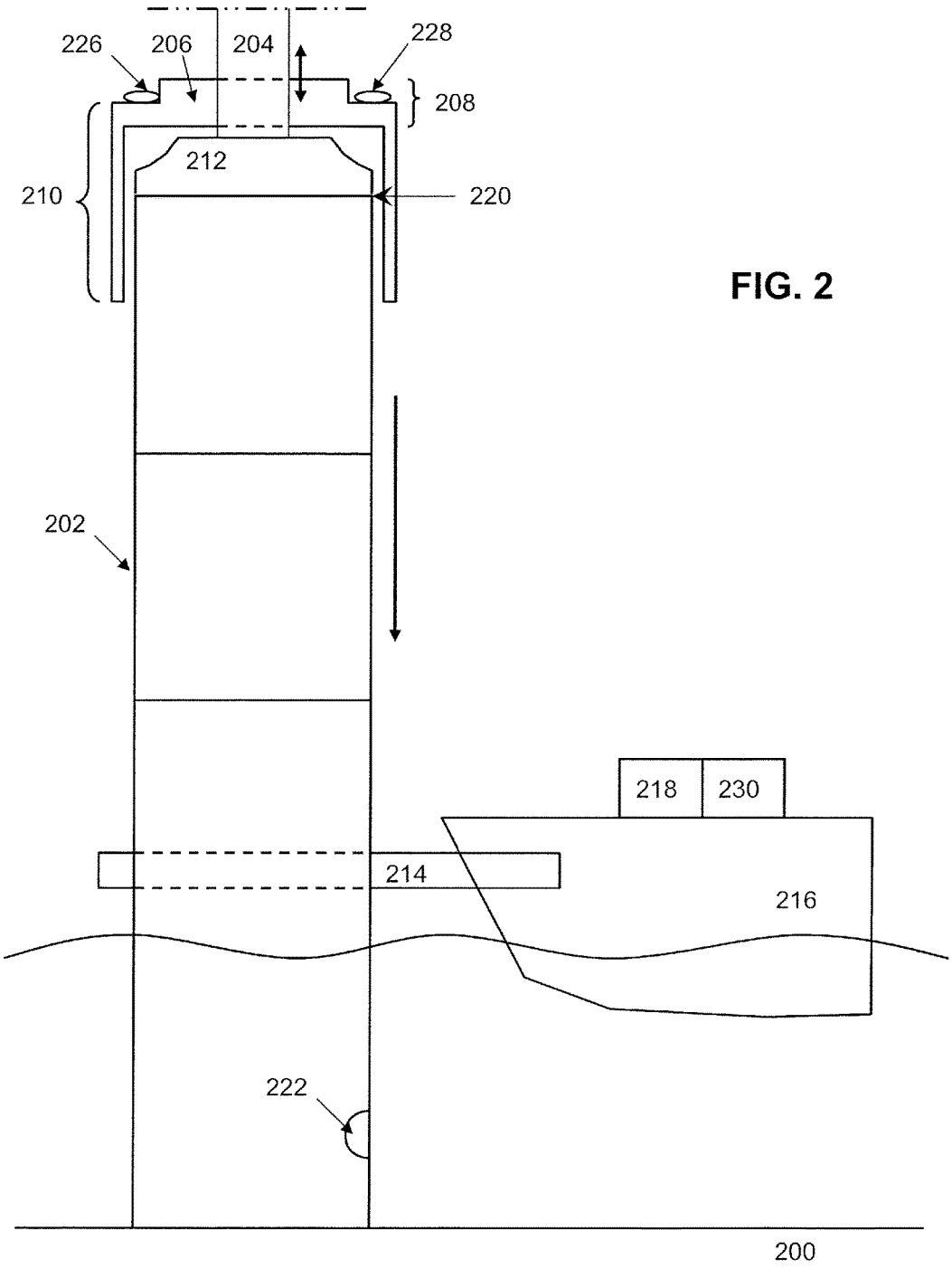
FIG. 2 shows an exemplary pile measuring system for determining parameters(s) of a pile and a pile driving system for driving a pile, according to one embodiment of the invention.

FIG. 2 shows, schematically, an exemplary pile measuring system for determining parameters(s) of a pile and a pile driving system for driving a pile, according to one embodiment of the invention. A pile measuring system is configured to measure parameter(s) of a pile during an installation of the pile. The pile driving system drives the pile into the ground, e.g., into a seabed under water.

The pile driving system comprises a pile driver, e.g., a Hydrohammer. The pile driver generally has a hammer 204 and a sleeve 206. The hammer and the sleeve are placed at the top of the pile, and are configured to drive the pile downwards into the ground 200. The sleeve comprises a top portion 208 and a circumferential portion 210 which surrounds but maintains a small distance, e.g., approximately 1 inch, from the top of the pile. The hammer cooperates with the sleeve at the top portion of the pile and is configured to abut an anvil 212 placed on the uppermost part of the pile. The hammer applies blows to the anvil to drive the pile. The anvil is configured to transfer the energy resulting from the impact of the blow from the hammer to the pile. Each blow successively drives the pile further into the ground. A gripper 214, e.g., on a vessel 216, is provided as part of the pile driving system, which is configured to adjust the placement of the pile. The gripper may be provided with a plurality of actuators, e.g., hydraulic actuators, to move the gripper and accordingly adjust the placement of the pile (i.e., by moving the pile). The pile may be installed into a ground that is underwater, and the gripper may be attached to a vessel (not shown). The gripper is configured to move the pile by, e.g., lifting, rotating, shifting, tilting, pushing, etc.

A pile measuring system measures parameter(s) of a pile, and the parameter(s) are preferably provided to and used by the pile driving system during an installation of a pile. The pile measuring system further comprises a parameter calculator 218 for determining or calculating the parameter(s) from or based on the position coordinates measured by the at least one positioning sensors. For instance, geometry formulas may be used to calculate the parameters based on where the position sensor(s) are installed in relation to the pile (and/or to each other, if more than one position sensor is used).

The parameters of a pile may include at least one of: position information, orientation information, inclination information, and depth information. Position information comprises or relates to position coordinates defined in a reference frame of the geography. Position information may relate to the position of the center point of the circular area (as seen from above) at the top/uppermost end of the pile 220. Position coordinates may include longitude and latitude coordinates, or any other coordinates in a suitable reference frame. Orientation information comprises or relates to the direction of a reference point of the pile, e.g., a compass direction. The reference point may relate to an opening 222 of the pile for cable entry. Thus, the orientation information may comprise or relate to the direction of the opening. Inclination information comprises or relates to the angle of tilt from the vertical, and may be defined in a first direction and a second direction. Depth information comprises or relates to elevation information at the top of the pile, or how far the pile is in the ground. For instance, depth information may relate to the elevation at the top end of the pile, e.g., distance from sea level, or distance from the center of the earth.

The pile measuring system comprises at least one positioning sensor, e.g., positioning sensor 226 and positioning sensor 228. Each positioning sensor is configured to measure position coordinates at the location of the positioning sensor.

An antenna that uses Global Positioning System (GPS) technology may be used as the positioning sensor, which is configured to determine position coordinates based on a plurality of satellite signals. Generally, each positioning sensor is configured to receive at least three different satellite signals or even four or more different satellite signals. From the satellite signals, the position coordinates comprising longitude information and latitude information may be determined. In some cases, the position coordinates further comprises elevation information. The accuracy of the positioning sensor is preferably within 5 centimeters or less. The position coordinates measured enable the parameter calculator to determine at least one of: position information, orientation information, inclination information, and depth information of the pile.

A positioning sensor in this disclosure is preferably attached or attachable to a location on the sleeve. Accordingly, the position coordinates measured by the positioning sensor corresponds to the respective location on the sleeve to which the positioning sensor is attached. Advantageously, by measuring position coordinates at the sleeve, the position information of the pile (i.e., the position of the center point at the top end of the pile) is measured substantially directly and accurately, relative to systems, which measure position information indirectly from a leader or a vessel. In some cases, measuring position coordinates at the sleeve provides a measurement of position information of the pile within approximately 1 inch of error from the actual position of the pile.

The accuracy of the positioning sensor is improved if the positioning sensor has an unobstructed view of the sky (i.e., such that satellite signals can be received without much degradation). Accordingly, at least one or more of the positioning sensors is preferably attached or attachable to a location on the top portion 208 of the sleeve. For instance, at least one positioning sensor is attached or attachable to an upper surface of the sleeve. In some embodiments, the positioning sensor is configured to measure position coordinates at a location substantially close to the uppermost part of the pile, or the top part of the pile. Being able to accurately measure the position at the uppermost or top part of the pile is advantageous since the uppermost or top part of the pile is the most critical part of the pile for placing a structure on top of the pile.

The center point of the circular area (as seen from above) at the top end of the pile cannot be directly measured due to the obstruction of the anvil and the hammer. However, by placing at least one positioning sensor on an upper surface of the sleeve, the position information relating to the center point of the circular area may be derived based on the measured position coordinates and an assumed/known distance of the location of the positioning sensor with the center point of the circular area, while measuring the position coordinates as close as practicable to the center point.

Although two positioning sensors are shown, it is envisioned that one, two, three, four, five, six, or more positioning sensors may be employed. The number of positioning sensors depends on the parameter(s) of the pile desired. Furthermore, more positioning sensors provide redundancy in the information measured, which would enable higher accuracy by accounting for deviations in the measurements by a subset of the positioning sensors.

When at least two positioning sensors are used, many parameters are determinable. For instance, when at least two positioning sensors may be placed in different locations substantially on a plane defined by the upper surface of the top portion of the sleeve, the parameter calculator can determine at least one of position information, orientation information, inclination information in a first direction, and depth information of the pile (if the positioning sensors are able to provide elevation information).

When at least three positioning sensors are placed in different locations substantially on a plane defined by the upper surface of the top portion of the sleeve, the parameter calculator can determine at least one of position information, orientation information, inclination information in a first direction, inclination information in a second direction, and depth information of the pile.

Positioning sensors may also be placed in the circumferential portion 210 of the sleeve, depending on the configuration, e.g., to measure inclination information. For instance, at least two positioning sensors may be arranged on the side of the sleeve along a vertical line to measure the angle of tilt in a first direction. At least two more positioning sensors may be arranged on the side of the sleeve along a different vertical line to measure the angle of tilt in another direction.

The pile driving system is controlled or controllable based on the parameter(s) of the pile determined by the pile measuring system. Advantageously, the pile driving system is adjustable to the changes in the parameter(s) of the pile during an installation of the pile.

The parameter calculator is configured to provide the parameter(s) to a pile driving control system 230. The pile driving control system advantageously reduces man-hours by surveyors and operators in adjusting the pile driving system during an installation of a pile. Accuracy is also improved over conventional methods and systems.

In some embodiments, the pile driving control system is configured to determine actuator parameter(s) for moving the gripper 214 from the parameter(s) of the pile. The pile driving control system may determine and issue commands for moving the gripper. The pile driving control system preferably is configured to adjust or position the pile in such a way to move the pile to towards a desired or planned position.

In some embodiments, the pile driving control system is configured to determine a hammer parameter for controlling the energy of the hammer. Based on the hammer parameters, the hammer is configured to adjust the blows applied to the pile based on the hammer parameter. In particular, the pile driving control system may receive depth information from the parameter calculator, and from the depth information, the pile driving control system determines a blow count. Blow count is typically a count or number of blows for driving the pile into the ground over a certain distance/change in depth of the pile. Based on a series of depth information provided by the parameter calculator, the pile driving control system can tabulate the number of blows for driving the pile by, e.g., 25 centimeters. During an installation of a pile, the planned specifications may require the installation to maintain a certain blow count for optimal results for the pile, e.g., strength, lifetime, structural integrity. Accordingly, the pile driving control system may adjust the energy of the hammer to meet the certain blow count desired.

Figure 3A:
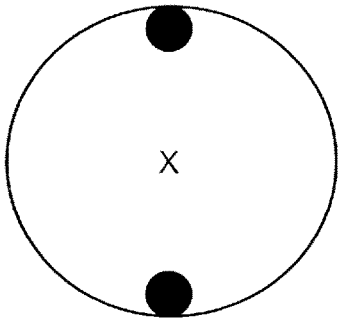
FIGS. 3A-3D show various illustrative configurations for the positioning sensors, according to several embodiments of the disclosure.
Figure 3B:
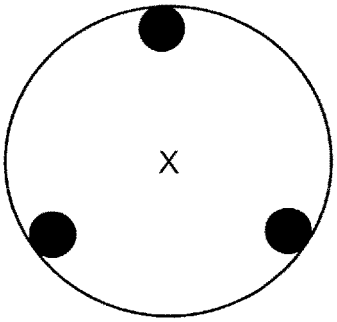
Figure 3C:
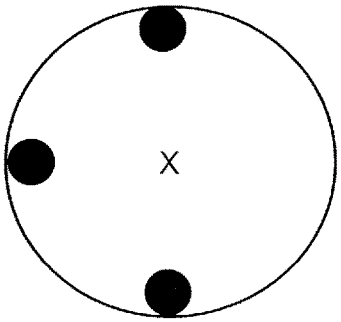

FIGS. 3A-C show various illustrative configurations for the positioning sensors, according to several embodiments of the disclosure. The figures show a top view of the sleeve (illustrated as a larger circle), with at least two positioning sensors (illustrated as small black circles). As shown, the positioning sensors are attached or attachable to a top portion of the sleeve, e.g., on an upper surface of the sleeve.

In some embodiments, such as the configuration shown in FIG. 3A, two positioning sensors are attached or attachable to the top portion of the sleeve along a line which crosses the center point denoted by the mark "X". The parameter calculator is then enabled to determine position information of the pile, i.e., the position of the center point of the circular area at the top end of the pile from the position coordinates measured by the two positioning sensors. The position coordinates measured by the two positioning sensors thus provides two points, and a line which may be drawn between the two points. The position information of the pile may be derived from the midpoint of the line which connects the two points provided by the position coordinates measured by two positioning sensors. Orientation information may be determined based on the direction of the line. Inclination information (inclination in one direction, in particular, the direction of the line connecting the two positioning sensors) may be determined from the elevation information measured by the two positioning sensors, e.g., based on the angle formed between the line and the horizontal. Depth information may be determined from the elevation information as well, e.g. by computing the elevation information at the center point. For instance, one skilled in the art may take the average of the elevation information measured by the two positioning sensors. One skilled in the art may apply geometry concepts in the parameter calculator to determine suitable arithmetic to determine the parameters of the pile.

In some embodiments, such as the configuration shown in FIGS. 3B and 3C, three positioning sensors are placed on the top portion of the sleeve at three locations. In FIG. 3B, the three positioning sensors are attached or attachable to the top portion of the sleeve at locations substantially equidistant from each other. In FIG. 3C, two of the three positioning sensors are attached or attachable to locations along a first line which crosses the center point, and one of the three positioning sensors are attached or attachable along a second line which is perpendicular to the first line and crosses the center point. One skilled in the art may apply geometry concepts in the parameter calculator, to determine parameters of the pile, said parameters including at least one of: position information, orientation information, inclination information in a first direction, inclination information in a second direction, and depth information.

Figure 3D:
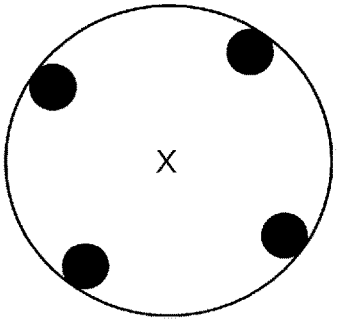

In some embodiments, such as the configuration shown in FIG. 3D, four positioning sensors are placed on the top portion of the sleeve at four locations that are substantially equidistant from each other. In this configuration, the same set of parameters of the pile can be determined. However, as compared to other configurations, the added positioning sensor provides redundancy, and thus the system is more tolerable to errors resulting from any one of the positioning sensors. In some other embodiments, five, six, or more positioning sensors may be employed.

Figure 4:
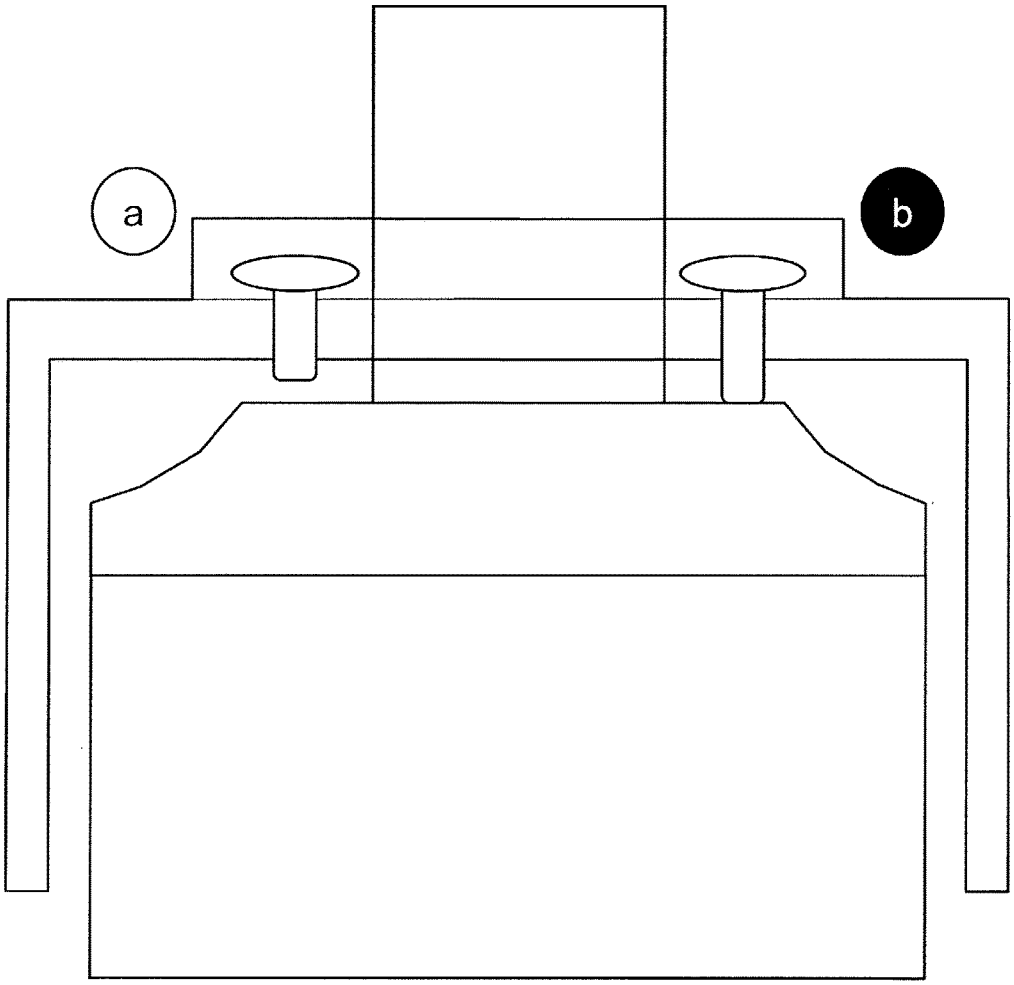
FIG. 4 shows an illustrative mounting mechanism for the positioning sensors to engage the pile for improved measurement, according to one embodiment of the disclosure.

FIG. 4 shows an illustrative mounting mechanism for the positioning sensors to engage the pile for improved measurement, according to one embodiment of the disclosure. The positioning sensors may be provided with a mounting mechanism which allows the positioning sensor to engage and disengage from the pile during an installation of the pile. During a blow, the impact of the hammer onto the pile may cause damage or other problems to the positioning sensor if the positioning sensor is placed directly onto the pile. Accordingly, the positioning sensors are attached or attachable to the sleeve instead of the pile. However, the distance between the sleeve and the pile may decrease the accuracy being able to derive the parameters of the pile itself from the position coordinates measured by the positioning sensors. Accordingly, the mounting mechanism provides a first position (denoted by "a") and a second position (denoted by "b") to prevent damage to the positioning sensors without having to attach the positioning sensors directly on the pile. In the first position, the positioning sensor is disengaged from the pile. During a blow, the mounting mechanism is preferably in the first position. In the second position, the positioning sensor is engaged with the pile. Before and/or after a blow, the mounting mechanism is preferably in the second position, such that position coordinates may be measured and provided to the parameter calculator. Advantageously, a more direct measurement of the parameters of the pile is achieved without having to attach the positioning sensors directly onto the pile.

Figure 5:
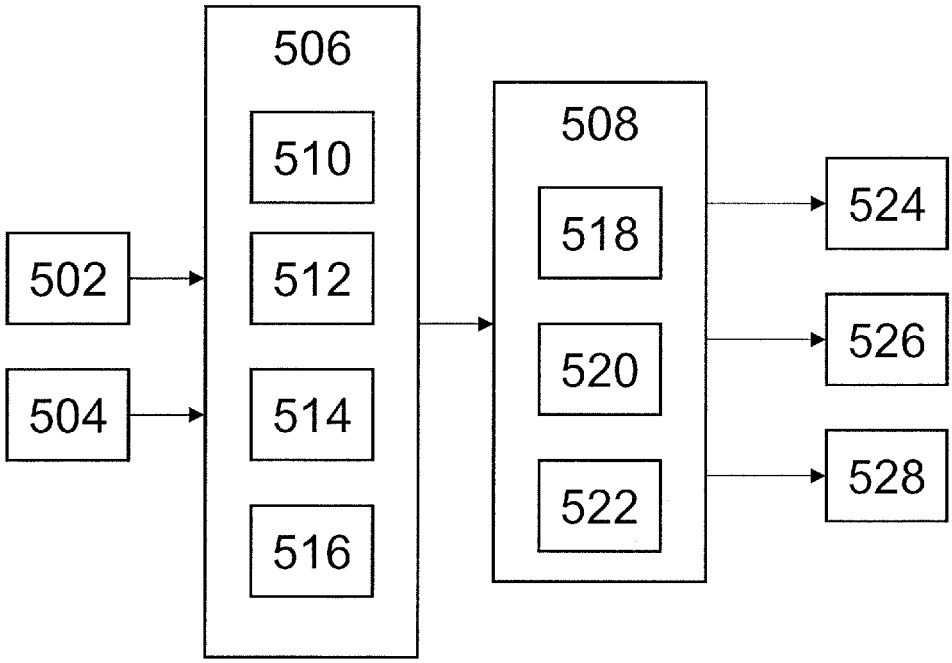
FIG. 5 illustrates an exemplary pile measurement system and an exemplary pile driving control system, according to one embodiment of the disclosure.

FIG. 5 illustrates an exemplary pile measurement system and an exemplary pile driving control system, according to one embodiment of the disclosure. The exemplary pile measurement system comprises positioning sensor(s) 502, and parameter calculator 506. In some embodiments, other sensors 504, such as air pressure sensors, digital compasses, etc., may be provided in addition to the positioning sensor(s). The positioning sensor(s) 502 is configured to provide position coordinates to the parameter calculator. The other sensors may provide other information related to the parameters of the pile, e.g., elevation information, direction, etc. To determine parameter(s) of the pile, the parameter calculator comprises at least one of: a position calculator 510, an orientation calculator 512, an inclination calculator 514, and a depth calculator 516. The position calculator 510 is configured to determine position information from at least the position coordinates provided by the positioning sensors 502. The orientation calculator 512 is configured to determine orientation information from at least the position coordinates provided by the positioning sensors 502. The inclination calculator 514 is configured to determine inclination information in a first direction and/or a second direction from at least the position coordinates provided by the positioning sensors 502. The depth calculator 516 is configured to determine depth information from at least the position coordinates, e.g., the elevation information, provided by the positioning sensors 502.

The determined parameter(s) of the pile is then provided to the exemplary pile driving control system 508. The pile driving control system 508 comprises at least one of: a gripper parameter calculator 518 and a hammer parameter calculator 520. The gripper parameter calculator 518 is configured to determine actuator parameter(s) for moving a gripper 524, said gripper 524 configured to position the pile. The hammer parameter calculator 520 configured to determine hammer parameter(s) for controlling the energy of the hammer 526, said hammer 526 configured to apply blows to the pile according to the energy and/or the timing. The pile driving control system 508 may be further configured to generate commands based on the actuator parameters and the hammer parameters. The actuator parameters and/or the hammer parameters (or the commands derived therefrom) are provided to the gripper 524 and the hammer 526 respectively.

In some embodiments, a report generator 522 is provided in the pile driving control system to record, e.g., in a storage, parameters of the pile provided by the pile measurement system. Such a report may include a time series report of the parameters of the pile. In some cases, the actuator parameters and/or the hammer parameters determined by the gripper parameter calculator 518 and/or the hammer parameter calculator 520 may be recorded and provided in said report.

The pile driving control system may render for displaying at least one of the following on a display 528: parameter(s) of the pile, actuator parameter(s), hammer parameter(s), the report. An operator may monitor the pile driving control system on the display 528.

Figure 6:
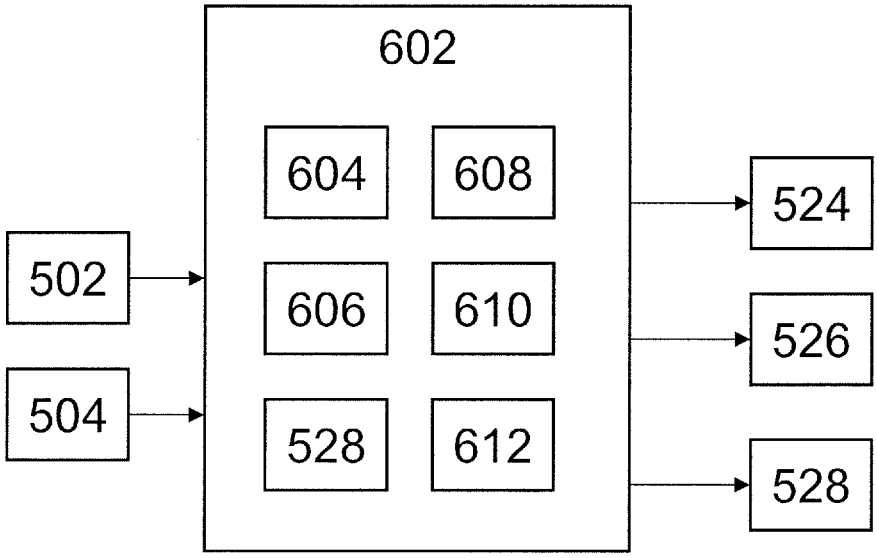
FIG. 6 illustrates a computer system for measuring a pile and controlling pile driving, according to one embodiment of the disclosure.

FIG. 6 illustrates a computer system for measuring a pile and controlling pile driving, according to one embodiment of the disclosure. The computer system 602 comprises input 604, output 606, processor 608, storage 610, and a pile driving application 612. The input 604 may include communication ports for receiving position coordinates from the positioning sensor(s) 502 and other sensors 504, over a wired connection or a wireless connection. The output 606 may include communication ports for the gripper 524 and the hammer 526, for providing actuator parameters, hammer parameters, or commands. In some embodiments, the computer system further comprises the display 528. The pile driving application is configured to be run on the processor 608, and the instructions for running the application may be stored in the storage 610. The pile driving application may be configured to implement the functionalities of the pile measurement system and/or the pile driving control system. Position coordinates, parameters of the pile, actuator parameters, hammer parameters, and/or any suitable data may be stored in the storage.

Figure 7A:
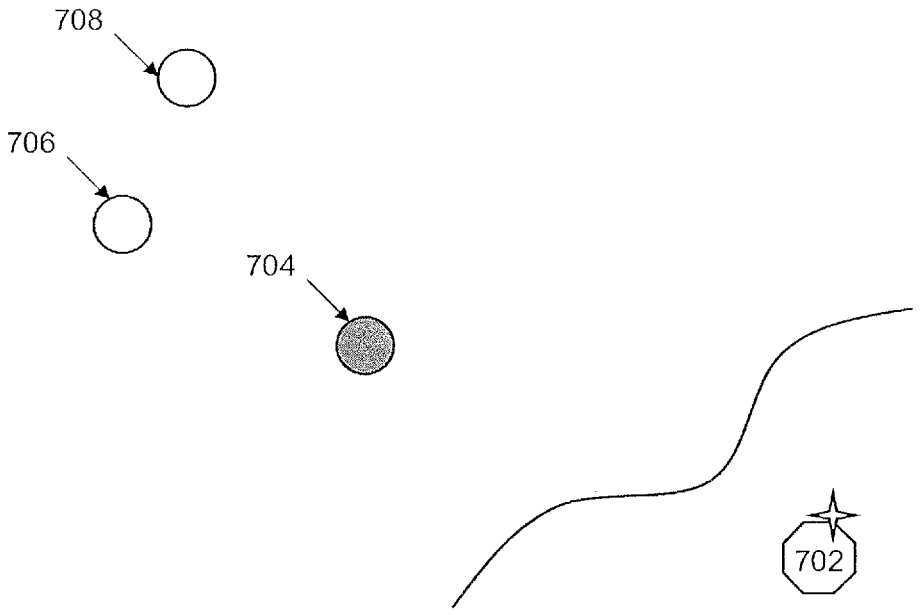
FIGS. 7A-B illustrate a method for measuring parameter(s) of a pile during an installation of a series of piles, according to one embodiment of the disclosure.
Figure 7B:
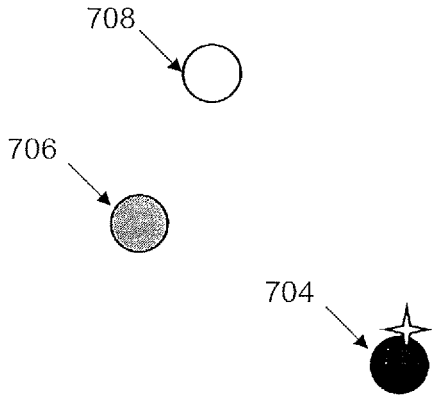

FIGS. 7A-B illustrate a method for measuring parameter(s) of a pile during an installation of a series of piles, according to one embodiment of the disclosure. The series of piles include a first pile 704, a second pile 706 and a third pile 708. The accuracy of the positioning sensors within 5 or less centimeters is provided by the use of a positioning beacon nearby the positioning sensors. The pile measuring system may include a positioning beacon 702, such that the accuracy can be achieved. Generally, hundreds of positioning beacons are installed at known locations around the world, e.g., on land. However, some piles are needed to be installed farther away from the positioning beacons, and thus it may be more difficult to reliably use the positioning beacon 702 as part of the pile driving system.

Typically, a positioning beacon 702 is configured to measure its own position coordinates from satellite signals. The positioning beacon 702 is further configured to provide/broadcast the difference(s) between the position coordinates measured from satellite signals and the known position coordinates of the positioning beacon. The known position coordinates may be provided by default, or the position coordinates are obtained from measured position coordinates recorded over a period of time.

In FIG. 7A, the method employs a positioning beacon (indicated by the star), e.g., on land, at location 702, during the installation of the first pile 704, using the methods and systems disclosed herein. After the first pile 704 is installed, as shown in FIG. 7B, the method provides a positioning beacon attachable or attached to the installed pile, said positioning beacon (denoted by a star) configured to measure position coordinates at the first pile 704 from satellite signals. As such, the first pile 704 becomes the location for the positioning beacon, which advantageously enables further piles, e.g., the second pile 706 and the third pile 708, to be installed at a location nearer to the positioning beacon (compared to the on land location 702). Said positioning beacon is further configured to provide, to the parameter calculator, a difference between the position coordinates at the first pile 704 measured from satellite signals and known position coordinates of the positioning beacon at the first pile 704 during an installation of the second pile 706, and/or the third pile 708.

With some modifications, one skilled in the art may extend the embodiments described herein to other technologies.

Various embodiments of the invention may be implemented as a program product for use with a computer system or a processor, where the program(s) of the program product define functions of the embodiments (including the methods described herein). In one embodiment, the program(s) can be contained on a variety of non-transitory computer-readable storage media (generally referred to as "storage"), where, as used herein, the expression "non-transitory computer readable storage media" comprises all computer-readable media, with the sole exception being a transitory, propagating signal. In another embodiment, the program(s) can be contained on a variety of transitory computer-readable storage media. Illustrative computer-readable storage media include, but are not limited to: (i) non-writable storage media (e.g., read-only memory devices within a computer such as CD-ROM disks readable by a CD-ROM drive, ROM chips or any type of solid-state non-volatile semiconductor memory) on which information is permanently stored; and (ii) writable storage media (e.g., flash memory, floppy disks within a diskette drive or hard-disk drive or any type of solid-state random-access semiconductor memory) on which alterable information is stored.

It is to be understood that any feature described in relation to any one embodiment may be used alone, or in combination with other features described, and may also be used in combination with one or more features of any other of the embodiments, or any combination of any other of the embodiments. Moreover, the invention is not limited to the embodiments described above, which may be varied within the scope of the accompanying claims.

The invention claimed is:

1. A pile measuring system suitable for determining one or more parameters of a pile during pile driving of the pile, said pile drivable into ground by a pile driver, said pile driver comprising a hammer and a sleeve, said hammer and said sleeve placed at a top of the pile, said pile measuring system comprising:

at least one positioning sensor, wherein the at least one positioning sensor is attached or attachable to a location on the sleeve and configured to measure position coordinates of the respective location on the sleeve during pile driving of the pile; and a parameter calculator configured to determine the one or more parameters of the pile from the position coordinates measured by the at least one positioning sensor during pile driving of the pile.

2. The pile measuring system according to claim 1, wherein the one or more parameters comprises position information of the pile.

3. The pile measuring system according to claim 1, wherein the parameter calculator is configured to provide the one or more parameters to a pile driving control system, said pile driving control system configured to determine one or more actuator parameters from the one or more parameters for moving a gripper, said gripper being configured to position the pile.

4. The pile measuring system according to claim 1, wherein the parameter calculator is configured to provide the one or more parameters to a pile driving control system, said pile driving control system configured to determine one or more hammer parameters for controlling energy of the hammer.

5. The pile measuring system according to claim 1, wherein the at least one positioning sensor is attached or attachable to an upper surface of the sleeve.

6. The pile measuring system according to claim 1, wherein each positioning sensor is configured to measure position coordinates at or substantially close to an uppermost part of the pile.

7. The pile measuring system according to claim 1, wherein:

each positioning sensor is a global positioning system antenna configured to receive at least three different satellite signals;

the position coordinates are determinable from the at least three different satellite signals; and the position coordinates comprises longitude information and latitude information, and preferably elevation information.

8. The pile measuring system according to claim 1, wherein:

the at least one positioning sensor comprises two positioning sensors; and the one or more parameters determinable by the parameter calculator comprises: orientation information of the pile.

9. The pile measuring system according to claim 8, wherein the one or more parameters determinable by the parameter calculator comprises inclination information of the pile in a first direction.

10. The pile measuring system according to claim 8, wherein the one or more parameters determinable by the parameter calculator comprises depth information of the pile.

11. The pile measuring system according to claim 1, wherein:

the at least one positioning sensor comprises three or more positioning sensors; and the one or more parameters determinable by the parameter calculator comprises inclination information in a first direction, inclination information in a second direction, and depth information of the pile.

12. The pile measuring system according to claim 1, further comprises:

a positioning beacon attachable or attached to the pile after the pile driving of the pile, said positioning beacon configured to measure position coordinates at the from satellite signals; and wherein said system is further configured to provide, to the parameter calculator and during installation of a further pile, a difference between the position coordinates of the beacon on the pile measured from satellite signals and known position coordinates of the beacon at the pile.

13. The pile measuring system according to claim 1, wherein the one or more parameters comprises orientation information of the pile.

14. The pile measuring system according to claim 1, wherein the one or more parameters comprises inclination information of the pile in a first direction.

15. The pile measuring system according to claim 14, wherein the one or more parameters comprises inclination information of the pile in a second direction.

16. The pile measuring system according to claim 15, wherein the one or more parameters comprises depth information of the pile.

17. A method for determining one or more parameters of a pile, such as position information, orientation information, inclination information, and depth information of the pile, during pile driving of the pile, said pile drivable into ground by a pile driver, said pile driver comprising a hammer and a sleeve, said hammer and said sleeve placed at a top of the pile, said method comprising:

providing at least one positioning sensor attachable on a location on the sleeve;

measuring, during pile driving, by the at least one positioning sensor, position coordinates of the location on the sleeve; and determining, during pile driving, by a parameter calculator, the one or more parameters of the pile from the position coordinates measured by the at least one positioning sensor.

18. The method according to claim 17, further comprising providing, by the parameter calculator, the one or more parameters of the pile to a pile driving control system, said pile driving control system comprising:

a gripper parameter calculator configured to determine one or more actuator parameters for moving a gripper, said gripper configured to position the pile.

19. The method according to claim 17, further comprising:

providing a positioning beacon attachable to the pile after the pile driving of the pile, said positioning beacon configured to measure position coordinates at the pile from satellite signals; and receiving, at the parameter calculator, a difference between the position coordinates at the pile measured from satellite signals and known position coordinates of the positioning beacon at the pile during an installation of another pile.

20. The method according to claim 17, further comprising providing, by the parameter calculator, the one or more parameters to a pile driving control system, said pile driving control system comprising:

a hammer parameter calculator configured to determine one or more hammer parameters for controlling energy of the hammer.

21. A computer program product, implemented on computer-readable non-transitory storage medium, the computer program product configured for, when run on a computer, executing a method for determining one or more parameters of a pile, such as position information, orientation information, inclination information, and depth information of the pile, during pile driving of the pile, said pile drivable into ground by a pile driver, said pile driver comprising a hammer and a sleeve, said hammer and said sleeve placed at a top of the pile, said method comprising:

providing at least one positioning sensor attachable on a location on the sleeve;

measuring, during pile driving, by the at least one positioning sensor, position coordinates of the location on the sleeve; and determining, pile driving, by a parameter calculator, the one or more parameters of the pile from the position coordinates measured by the at least one positioning sensor.

* * * * *